US006588679B1

(12) United States Patent
King

(10) Patent No.: US 6,588,679 B1
(45) Date of Patent: Jul. 8, 2003

(54) WIND-OPERATED SPRINKLER FEATURE

(75) Inventor: Courtney A. King, Ypsilanti, MI (US)

(73) Assignee: Bird Brain, Inc., Ypsilanti, MI (US)

( * ) Notice: Subject to any disclaimer, the term of this patent is extended or adjusted under 35 U.S.C. 154(b) by 0 days.

(21) Appl. No.: 09/631,068

(22) Filed: Aug. 1, 2000

(51) Int. Cl.[7] ..... B05B 3/06

(52) U.S. Cl. ..... 239/251; 239/289; 239/17; 239/261; 239/273

(58) Field of Search ..... 239/251, 225.1, 239/246, 245, 261, 264, 265, 289, 276, 273, 279, 17; D23/213–217; D10/59; 416/196 A, 197 A; 73/107.05

(56) References Cited

U.S. PATENT DOCUMENTS

| | | | | | |
|---|---|---|---|---|---|
| 471,817 | A | * | 3/1892 | Green | 416/197 A |
| 543,993 | A | | 8/1895 | Kohler | |
| 671,485 | A | | 4/1901 | Johnston | |
| 2,607,625 | A | * | 8/1952 | Salmonese | 239/251 |
| 2,671,651 | A | | 3/1954 | Schellenburg | |
| D269,034 | S | | 5/1983 | Wood | |
| 4,609,152 | A | * | 9/1986 | Hernandez | 416/197 A |
| 5,419,494 | A | * | 5/1995 | Harwood | 239/251 |
| D390,313 | S | | 2/1998 | Smith | |
| D390,911 | S | | 2/1998 | Smith | |
| D390,912 | S | | 2/1998 | Smith | |
| D391,339 | S | | 2/1998 | Smith | |
| D394,463 | S | * | 5/1998 | Filho | D21/93 |
| D403,743 | S | | 1/1999 | Smith | |
| D412,553 | S | | 8/1999 | Krueger | |
| D413,963 | S | | 9/1999 | Krueger | |
| D414,841 | S | | 10/1999 | Krueger | |
| D414,842 | S | | 10/1999 | Krueger | |
| D415,820 | S | | 10/1999 | Krueger | |
| D419,639 | S | | 1/2000 | Ormiston | |
| 6,015,098 | A | | 1/2000 | Krueger | |
| 6,109,546 | A | | 8/2000 | Ormiston | |
| 6,202,937 | B1 | * | 3/2001 | King | 239/251 |
| D441,423 | S | * | 5/2001 | Goknur et al. | D23/214 |
| 6,422,913 | B1 | * | 7/2002 | Trejo | 73/170.05 |

OTHER PUBLICATIONS

Windancers Garden Weather Vanes, *Bird Brain, Inc.* Catalog (1999).

Rain Danders Copper Sprinklers w/optional Weather Vane, *Bird Brain, Inc.* Catalog (1999).

David Fisher and Reginald Bragonier, Jr., *What's What—A Visual Glossary of the Physical World*, 1981, p. 18, Hammond, USA.

* cited by examiner

*Primary Examiner*—Michael Mar
*Assistant Examiner*—Dinh Q. Nguyen
(74) *Attorney, Agent, or Firm*—Young & Basile, P.C.

(57) ABSTRACT

A wind-driven decorative feature mounted inside the rotating head of an upright, standpipe-type sprinkler. The wind-driven device is mounted inside the sprinkler head for rotation independent of the rotation of the spray tubing portion of the sprinkler head, and is generally located in the region bounded by the rotation of the sprinkler head itself and the spray pattern emitted by the sprinkler head.

10 Claims, 6 Drawing Sheets

WIND-OPERATED SPRINKLER FEATURE

FIELD OF THE INVENTION

The present invention is in the field of sprinklers, and in particular the class of decorative standpipe-type sprinklers in which a decorative sprinkler head of copper tubing rotates on a standpipe.

BACKGROUND OF THE INVENTION

Tall, decorative, upright lawn sprinklers are well-known. One particular kind uses a vertical standpipe with a sprinkler head located at the top. The standpipe and/or the sprinkler head may include decoration and sculpture-like designs. Some of these designs even throw a decorative water pattern, depending on the manner in which spray holes in the sprinkler head are arranged.

These standpipe-type sprinklers function primarily as garden or lawn art, in addition to their often secondary sprinkling function. People buy them primarily because they are attractive and beautiful sculptural works which look good in gardens and on lawns, whether sprinkling or not (and most of the time they are not). Accordingly, new and different designs in the form of differently-shaped sprinkler tubing and internal decoration are being invented and created to satisfy the demand for pleasing sculptural and artistic arrangements.

A first class of efforts have focused on decorative, ornamental designs for the spray-tubing of the sprinkler head, i.e., typically the outermost portion of the sprinkler head formed from metal tubing such as copper and provided with a pattern of spray holes to emit the water in a decorative pattern.

A second class of efforts at creating pleasing designs is focused on the "internal" portion of the sprinkler head comprising the area inside the spray-tubing. This portion does not have a spray function, but merely comprises interior decoration to fill the space inside the spray-tubing of the sprinkler head. To date, decorative interior designs first included metal tubing, piping, and wire bent and formed into various artistic patterns and designs, and more recently have included glass features such as gazing balls, colored glass bulbs, and the like.

SUMMARY OF THE INVENTION

The present invention is a wind-operated device mounted for rotation inside the spray-tubing portion of an upright, standpipe-type sprinkler with a rotating head. The wind-operated device is mounted to rotate independently of the rotation of the spray tubing portion of the sprinkler head, and in particular is operated primarily by the wind (rather than the rotation of the spray tubing portion of the sprinkler head, although some minor frictional impartation of movement to the wind-operated device may be imparted by the rotating sprinkler head in windless conditions).

In a first version of the invention, the wind-operated device is essentially two-dimensional, i.e., capable of lying at rest within the plane of the sprinkler head tubing.

In a second version of the invention, the wind-operated feature is three-dimensional, i.e., with portions extending at rest outside the plane of the typically planar spray tubing portion of the sprinkler head.

The present invention also includes several specific embodiments of rotatable bearing arrangement for securely mounting the rotatable wind-operated feature inside the spray tubing portion of the sprinkler head. In a first form, the wind feature mount is an upright post extending from a bottom portion of the sprinkler head in coaxial alignment with the standpipe, and a bearing rotating on the upper end of the post with the wind-operated feature connected thereto. The wind-operated feature in the first version therefore simply rests on top of the post on a bearing.

In a second version of a mounting arrangement, bearing supports extend both from bottom and top portions of the spray tubing portion of the sprinkler head (therefore primarily being useful in fully-enclosed spray tubing) each with a rotatable bearing mounted thereon. In a preferred form the wind-operated feature is connected to these upper and lower bearings, and comprises a work of art spanning the gap between the bearings. In the most preferred form of this second version, the wind-operated feature comprises a plurality of wind-catching, decorative elements which arc between outside surfaces of the bearings such that a space is created between the bearings. In yet a further preferred form, at least the lower of the set of bearings comprises a mount for an internal decorative feature inside the wind-catching portions, which feature may or may not be wind driven and in which in one form comprises a decorative glass piece such as a gazing ball.

In a third version of the mounting arrangement, the rotatable bearing is a retrofit or add-on feature adapted to fit into the common blind bore socket protruding up from the bottom portion of the sprinkler head in line with the standpipe (and often forming an extension of a T-shaped, water-conducting fitting connected to receive water from the standpipe).

These and other features and advantages of the invention will become apparent upon further reading of the specification in light of the accompanying drawings.

DETAILED DESCRIPTION OF THE ILLUSTRATED EMBODIMENTS

Figure 1:
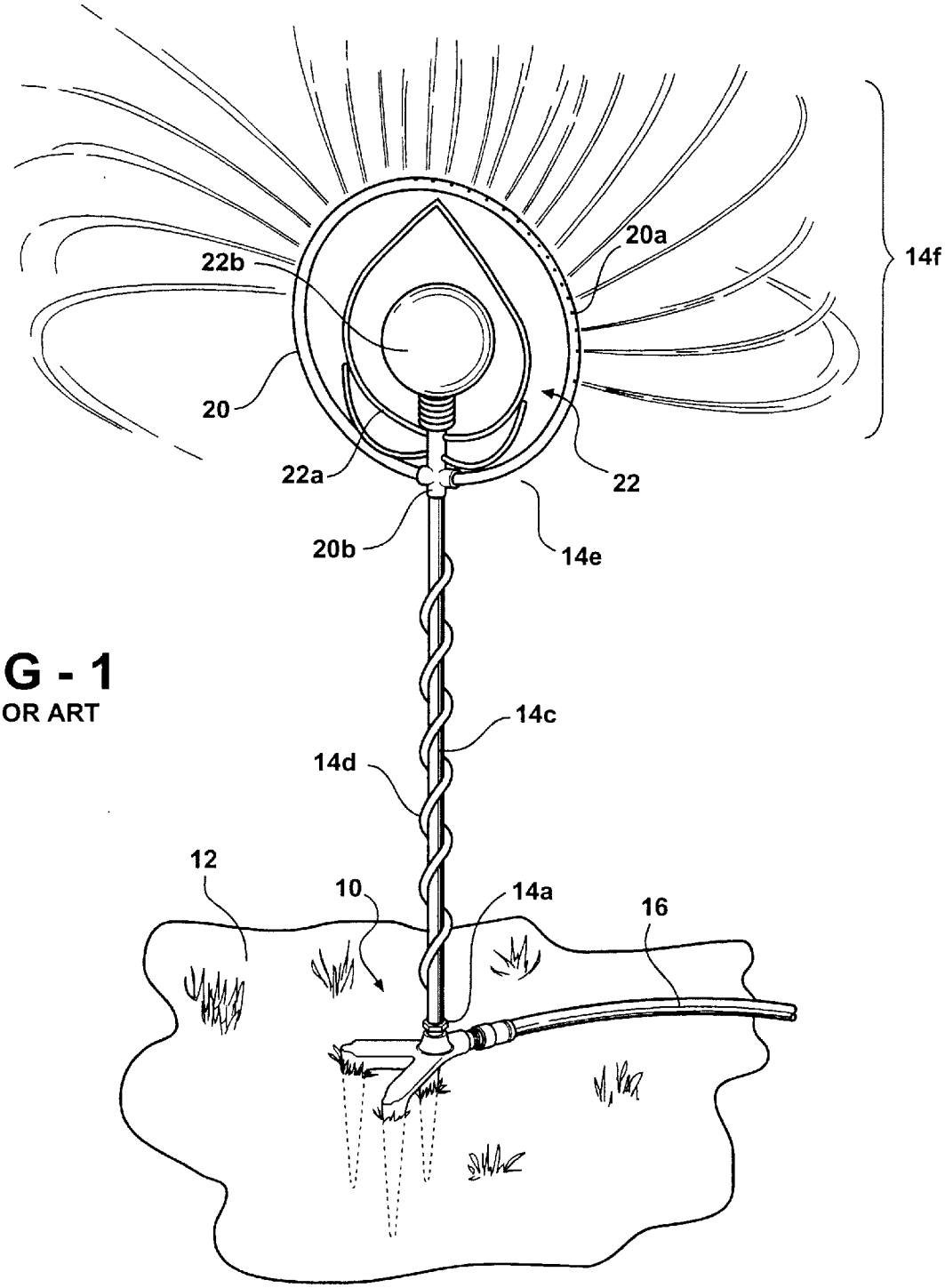
FIG - 1 PRIOR ART
FIG. 1 is a perspective view of a prior art standpipe-type sprinkler having a combination of sculpted metal tubing and glass decoration adorning the interior space of the sprinkler head inside the spray tubing.

Referring first to FIG. 1, a prior art decorative standpipe-type sprinkler is generally denoted at 14. Sprinkler 14 is supported on a sprinkler base 10 shown inserted in a lawn 12, and supplied with water from a hose 16.

Sprinkler 14 is of the vertical standpipe type with a hollow cylindrical standpipe 14*c* connected to sprinkler base 10 with a threaded coupling 14*a*. The upper end of standpipe 14*c* supports a decorative, sculpture-like sprinkler head 14*e* of a type which is generally known and commercially available, which comes in a wide variety of designs and forms, and which provides a water spray pattern 14*f*, with the result that sprinkler head 14*e* rotates on the upper end of standpipe 14*c* to provide better coverage of the lawn and a decorative spray pattern.

Standpipe 14*c* is sometimes provided with external decoration such as that shown at 14*d*.

Sprinkler head 14*e* typically comprises an outer portion of spray tubing 20 comprising hollow tubing, such as copper, with a pattern of holes 20*a*provided in a pattern on the outside thereof (and typically on the upper half or two-thirds thereof) to emit water spray 14*f* in a pattern which drives sprinkler head 14*e* in rotation on pipe 14*c*, for example a rotatably mounted fitting such as 20*b*.

The interior of sprinkler head 14*e*, i.e., the area bounded by spray tubing 20, is often provided with interior decoration generally denoted at 22, in the illustrated embodiment comprising an artistic array of copper tubing 22*a* and a glass "gazing ball" 22*b* mounted on an upright socket extending from rotatable fitting 20*b*. Tubing 22*a* is fixed to spray tubing 20 at the points where it contacts the spray tubing, for example by soldering, brazing, or welding. The manner of securing gazing ball 22*b* in a blind bore socket extending up from rotatable fitting 20*b* is one which is known to those skilled in the art, and is commercially available from the assignee of the present application. One possible method is a friction fit plug extending from the base of the gazing ball 22*b* into a blind bore socket in the extension from rotatable fitting 20*b*.

Interior decoration 22, being fixed to the spray tubing and/or fitting 20*b*, rotates with sprinkler head 14*e* under the drive of spray pattern 14*f*

Figure 2A:
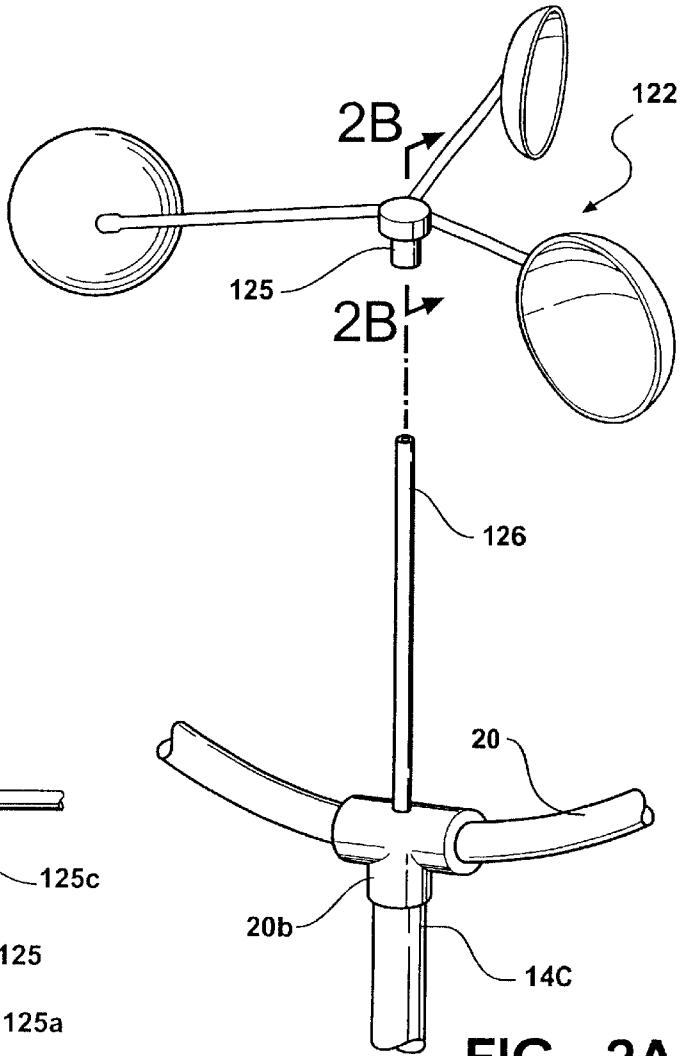
FIG. 2A is an exploded view showing the wind-driven device of FIG. 2 removed from its mounting on the sprinkler head.
Figure 2B:
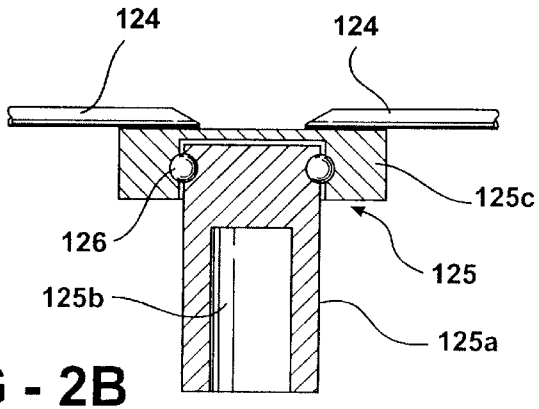
FIG. 2B is an elevational view, in section, of the rotating bearing of the wind-driven device of FIG. 2.
Figure 2:
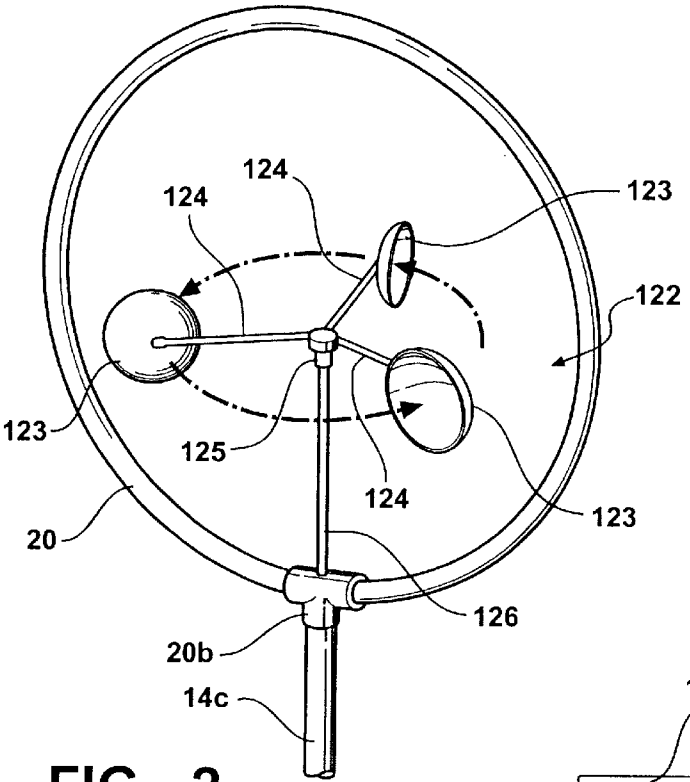
FIG. 2 is a perspective view of a sprinkler head with a first embodiment of the invention mounted therein.

Referring next to FIGS. 2, 2A, and 2B, a first embodiment of the present invention takes the form of an improved decorative interior assembly 122 in the form of an independently rotatable, wind-driven, and aesthetically pleasing device which adds a multiple motion dimension to the sprinkler as a whole. Device 122 is located within the interior of spray tubing 20, in the "dry zone" defined by the spray tubing and the spray pattern as it is initially emitted from spray tubing 20. It will of course be understood that the interior portion or dry zone in which device 122 is mounted may occasionally get wet as certain portions of the spray pattern subsequently fall back onto the sprinkler or are blown into it on a windy day. However, as the water is initially emitted from the spray tubing, the region can be considered generally dry. This is simply a convenient way of describing the interior portion of the sprinkler head where the wind-operated device 122 can be actuated by the wind independently of and within the sweep of rotation of spray tubing 20 on standpipe 14*c*, and within the sweep of the spray pattern 14*f* being emitted from the spray tubing.

In the illustrated embodiment of FIG. 2, device 122 comprises a three-legged array of wind catching cups 123 connected by legs or spokes 124 to a bearing 125 rotating on a support 126. Support 126 is secured to the sprinkler head, and in particular to rotatable fitting 20*b*, and rotates therewith, but the rotatable nature of bearing 125 substantially isolates device 122 from the rotation of the sprinkler head as a whole, allowing device 122 to rotate independently of the sprinkler head under force of wind.

Preferably, although not necessarily, device 122 is designed to rotate in a direction opposite the rotation of sprinkler head spray tubing 20.

In the illustrated embodiment, device 122 is made from one or more metals suitable for use in a sprinkler environment, preferably copper and/or brass, in particular with bearing 125 being formed from brass for a smooth rotation on post 126. However, it will be understood by those skilled in the art that other materials can be used, for example various combinations of metal, glass, and/or plastic.

In the illustrated embodiment, metal cups 123 are welded, soldered or brazed to the ends of legs 124, which in turn are welded, soldered or brazed to bearing 125.

Referring to FIGS. 2A and 2B, the nature of the rotatable connection between device 122 and a support such as 126 is not critical, provided device 122 rotates on the support essentially independently of the rotation of spray tubing 120. This requires a relative friction-free bearing between device 122 and the support on the sprinkler head. It can be achieved with structure as simple as that shown in FIGS. 2A and 2B, namely a brass bearing 125 whose stem 125*a* has a smoothly finished blind bore 125*b* with a diameter sized to fit in a close but smoothly rotatable fit over support 126, which in turn may be formed of copper or brass. FIG. 2B further illustrates bearing 125 as having a two-part construction, with stem 125*a* and an upper, separately formed head 125*c* to which it is connected in a snap fit over a retaining ring 126.

Figure 3:
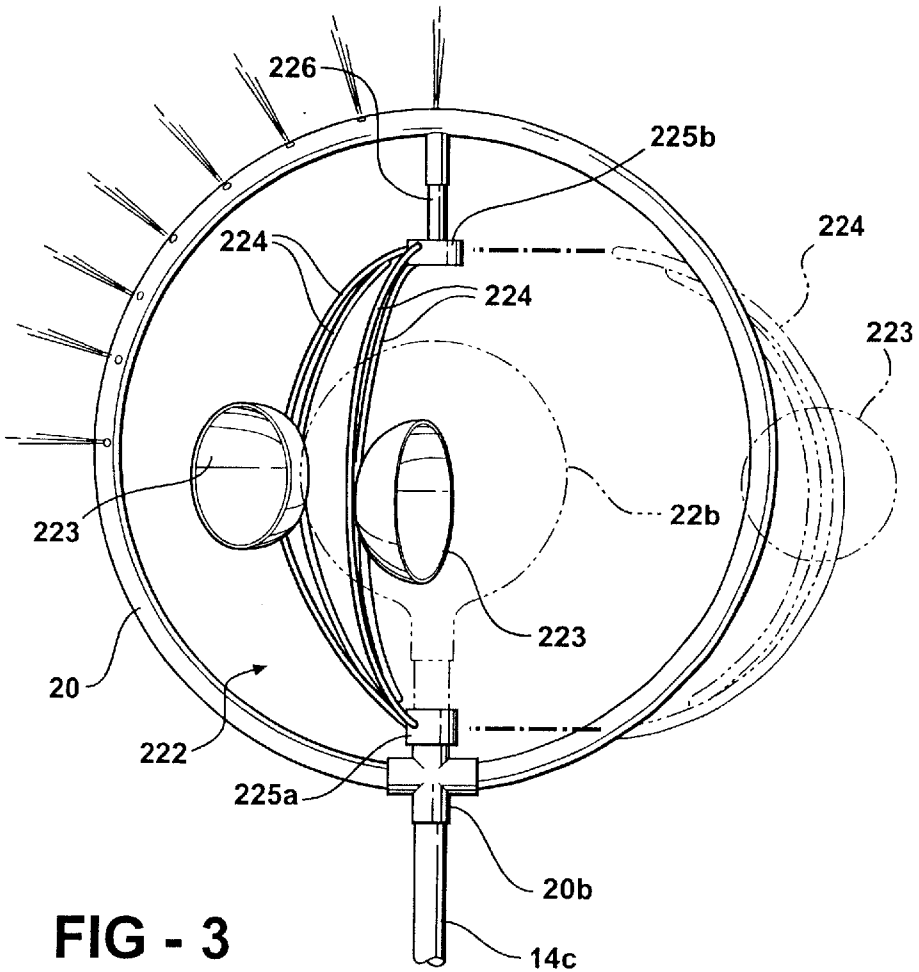
FIG. 3 is an elevational view of a sprinkler head with a second embodiment of the invention mounted therein.
Figure 3A:
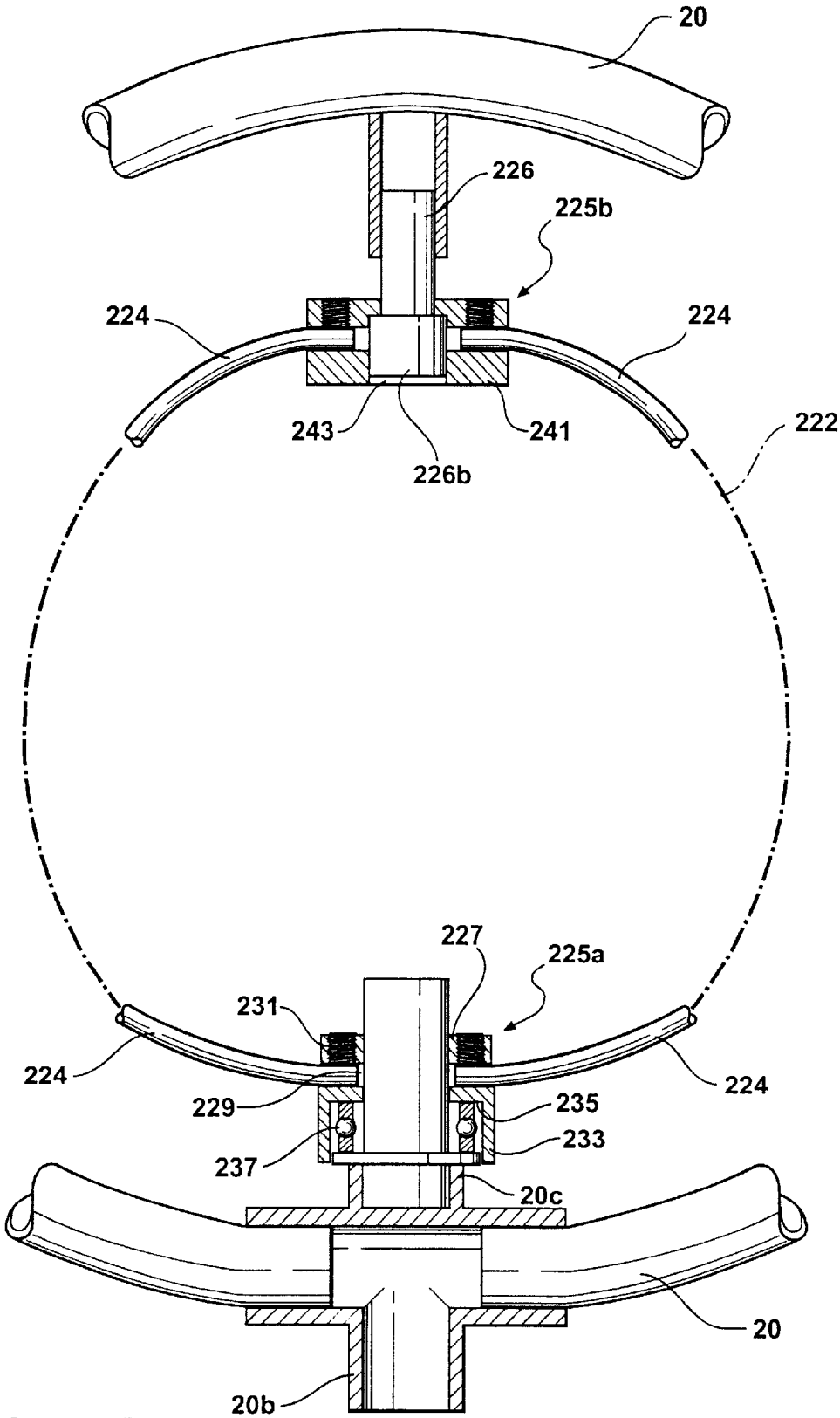
FIG. 3A is an elevational view, partly in section, of the upper and lower rotatable fittings of the wind-driven device of FIG. 3.

A second embodiment of the invention is illustrated in FIGS. 3 and 3A, comprising a wind-driven device 222 mounted for independent, wind-driven rotation in the interior of the sprinkler head bounded by spray tubing 20 and its spray pattern 14*f*. Device 222, like device 122 in FIG. 2, comprises a plurality of wind-catching cups 223 secured to legs 224 whose ends are secured to rotatable mounts inside the sprinkler head. However, in the embodiment of FIG. 3, device 122 is connected to lower and upper rotatable bearings at bottom and top portions of the sprinkler head. Lower bearing 225*a* is rotatably mounted on an upper extension of fitting 20*b* while upper bearing 225*b* rotatably depends from a support post 226. As illustrated in phantom in FIG. 3, at least one, and preferably all, of leg sets 224 are removably secured at their upper and lower ends to bearings 225*a*, 225*b*, allowing them to be disassembled and packed flat for storage, allowing for their removal for replacement or repair, and as further illustrated in phantom, allowing a further decorative feature such as gazing ball 22*b* to be conventionally mounted within the rotational confines of wind-driven device 222. For this purpose lower bearing 225*a* is preferably designed to allow access to the upright extension of rotatable fitting 20*b* for mounting of the gazing ball.

Like device 122 in FIG. 2, device 222 in FIG. 3 rotates independently of the rotation of spray tubing 20 and may be driven in the opposite direction of rotation by the wind, depending on the orientation of wind-catching features such as cups 223.

Referring to FIG. 3A, the details of upper and lower bearings 225*a*, 225*b* are shown in section, with each bearing generally comprising a brass disc-like member having apertures sized to receive the ends of legs 224 and structures such as set screws to removably secure the ends of legs 224 in the bearings.

Lower bearing 225*a* comprises a brass, generally disc- or cup-shaped body 227 with apertures 229 to receive the ends of legs 224. Set screws 231 are accessible from the upper surface of the bearing to be tightened against and loosened from the ends of legs 224 to removably secure them in the bearing.

It will be understood by those skilled in the art that the structure of bearing member 225*a* may take many different forms, whether commercially available standard fittings adapted to the invention, or whether made from scratch. Those skilled in the art are perfectly capable of making many different types of bearings which will suffice for the present invention, the embodiment illustrated in FIG. 3A merely being one of many possible structures. In the illustrated embodiment, brass body 227 has a circular, smoothly machined region 223 cut out of its lower face, defining a bearing surface 235 which rotatably rests on a bearing ring 237 of conventional type secured to the upright extension portion 20*c* off sprinkler head fitting 20*b*. Body 227 therefore is free to rotate around extension 20*c* such that device 222 is rotatably independent of spray tubing 20.

Upper bearing 225*b* in FIG. 3A is somewhat simpler, comprising a generally disc- or cup-shaped brass body 241 having an annular cut-out region 243, smoothly machined, adapted to fit over and rest on the upper shoulder of a brass bearing surface 226*b* at the lower end of post 226 whose upper end is secured in fixed, in non-rotating fashion to an upper portion of spray tubing 20.

Figure 4:
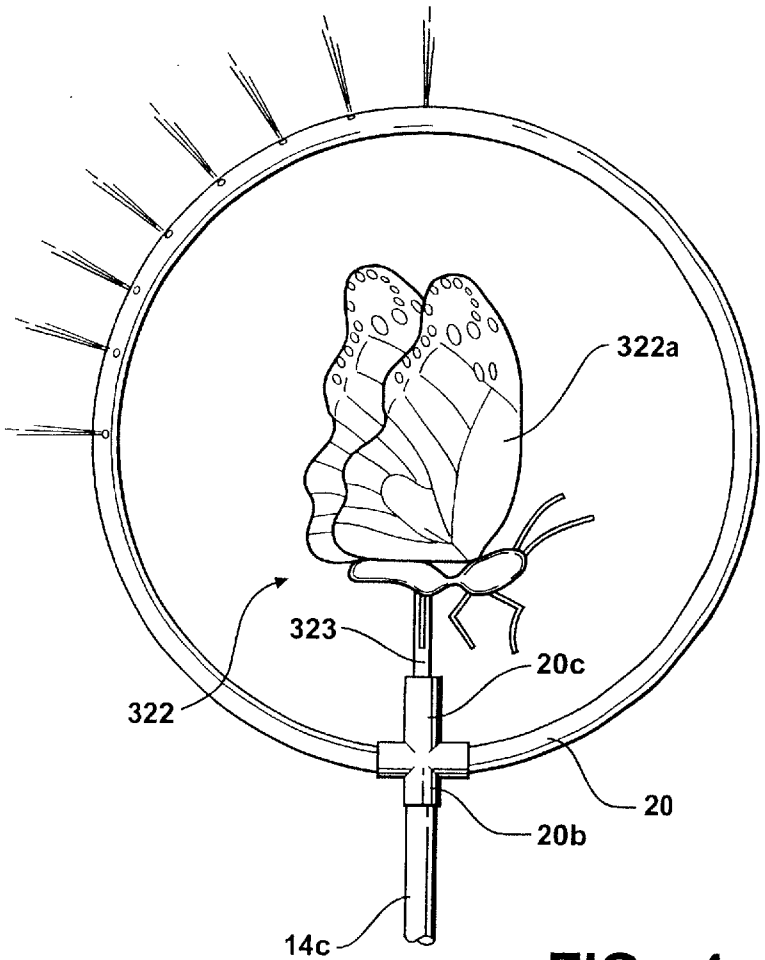
FIG. 4 is an elevational view of a sprinkler head with a third embodiment of the invention mounted therein.

Next referring to FIG. 4, a third embodiment of the invention is generally illustrated as wind-driven feature 322 mounted for independent wind-driven rotation inside spray tubing 20. Device 322 generally differs from the devices 122, 222 in that it is essentially two-dimensional, in the illustrated embodiment comprising a flat, stamped decoration which is preferably asymmetrical about its axis of rotation so as to rotate in the wind.

Specifically, device 322 comprises a flat stamping of metal such as copper, bronze, or brass (although it could comprise glass, plastic or wood having a wind catching body 322*a* supported at its lower end on a post 323 rotatably secured in extension 20*c* of sprinkler head fitting 20*b*.

It will be appreciated by those skilled in the art while device 322 (and devices 122, 222) are secured for rotation on axes aligned with vertical standpipe 14*c*, which is the highly preferred orientation since it effectively isolates the rotatable wind-driven element from the rotation of sprinkler head on the standpipe, other axial arrangements inside the sprinkler head would be possible although the wind-driven feature would then rotate with the sprinkler head on the standpipe axis in addition to its rotation imparted by the wind on its wind axis.

Figure 4A:
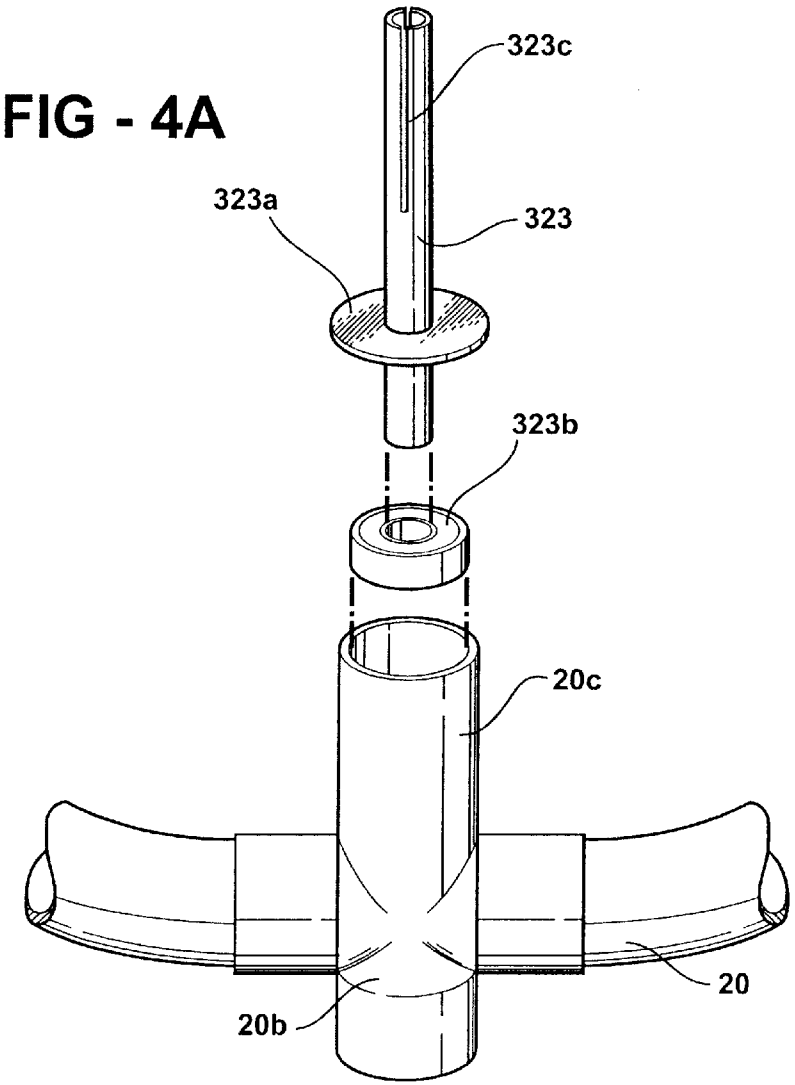
FIG. 4A is a perspective, exploded view of the rotatable fitting of the wind-driven device of FIG. 4.

Referring to FIG. 4A, the details of the rotating support 323 in FIG. 4 are illustrated in an exploded view. Rotating post 323, which may comprise copper for example, has secured thereto a disc 323*a* which limits the distance it may be inserted inside extension 20*c* of the sprinkler head fitting. The ease of rotation of post 323 on extension 20*c* may be improved by the addition of a bearing 323*b* inserted partly into, or flush with, extension 20*c* and having specially machined bearing surfaces and/or lubricating features to improve the ease of rotation of disc 323*a* thereon. The upper end of post 323 is provided with a simple slot to receive a flat flange or tab from wind device 322 as illustrated in FIG. 4.

Figure 5:
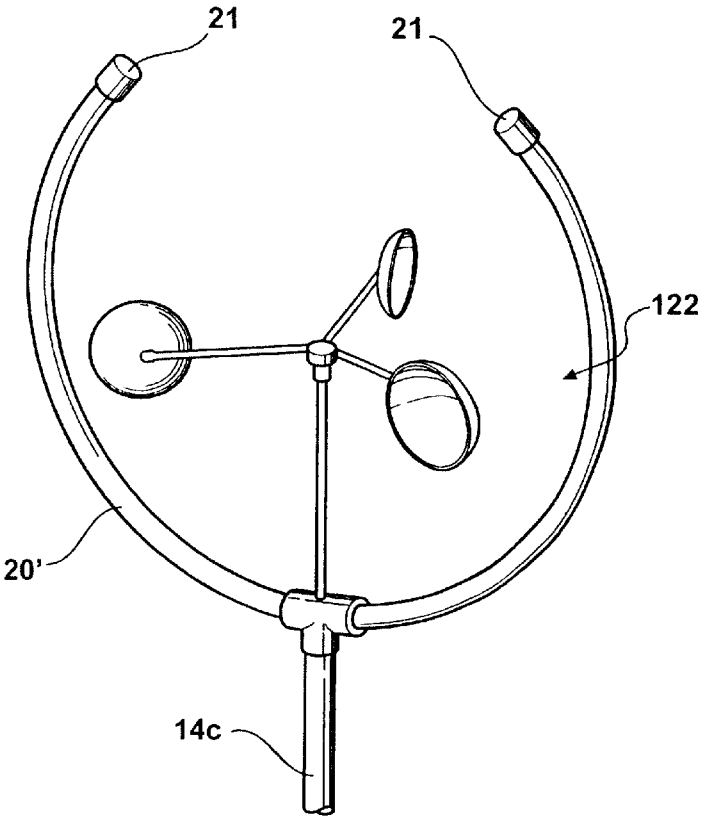
FIG. 5 is a perspective view of an alternate form of sprinkler head with the wind-driven device of FIG. 2 mounted therein.
Figure 6:
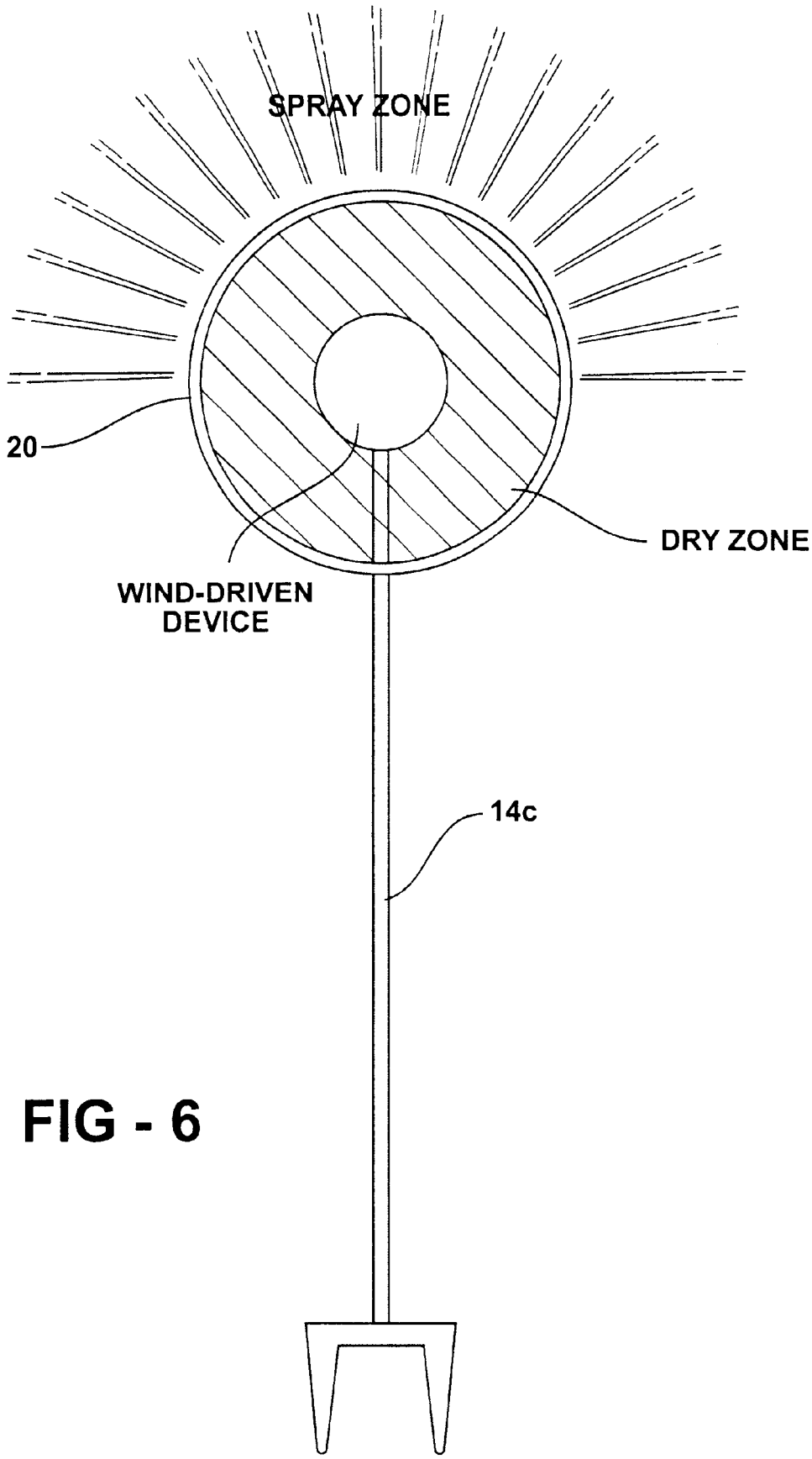
FIG. 6 is a schematic illustration of the invention.

Referring to FIG. 5, a modified version of the embodiment of FIG. 2 is illustrated, demonstrating that the wind-driven device according to the invention need not be totally enclosed by the spray tubing. Rather, its relationship to the standpipe sprinkler head is defined primarily by its being located in the "dry zone" bounded by the spray pattern as initially emitted from the spray tubing. This is perhaps best shown in the schematic illustration of the invention shown in FIG. 6, in which the wind-driven device of whatever type (for example 122 as shown in FIG. 2, 222 as shown in FIG. 3, or 322 as shown in FIG. 4) is rotatably mounted in the "dry zone" bounded by the spray pattern emitted from spray tubing 20, and preferably inside the rotational area bounded by the sprinkler head to the extent that the spray tubing partially or fully encloses the wind-driven device.

From the foregoing illustrative examples of the invention, it will be apparent to those skilled in the art that the invention may take many different forms in the context of an upright standpipe-type sprinkler with a rotating sprinkler head comprising spray tubing in different patterns or configurations. The form which the wind-driven device takes is almost limitless, as it is subject to great artistic variation in keeping with the aesthetic needs of the designer and user. They have in common the fact that they are mounted for independent, wind-driven rotation inside the spray pattern of the sprinkler head on the upper end of the standpipe. Accordingly, many variations and modifications of the invention are possible and will be apparent to those skilled in the art now that I have disclosed specific examples of my invention.

Accordingly, I claim:

1. In an upright standpipe-type sprinkler having a sprinkler head mounted for rotation on the standpipe and rotated by a spray of water emitting from the sprinkler head, an interior decorative portion comprising:

a wind-driven device mounted for independent rotation on an interior portion of the sprinkler head bounded by the spray pattern.

2. The apparatus of claim 1, wherein the sprinkler head comprises one or more lengths of spray tubing substantially enclosing an interior region bounded by the rotation of the spray tubing and the spray pattern, and the wind-driven device is located within a region substantially enclosed by the spray tubing.

3. The apparatus of claim 1, wherein the wind-driven device is mounted for independent rotation on an axis substantially coinciding with the axis of rotation of the sprinkler head on the standpipe.

4. The apparatus of claim 1, wherein the wind-driven device is rotatably secured to a support on the sprinkler head.

5. The apparatus of claim 1, wherein the sprinkler head comprises an arrangement of spray tubing lying in a first plane, and the wind-driven device is a three-dimensional device which in its rest position has portions extending outside of the first plane defined by the sprinkler head.

6. The apparatus of claim 1, wherein the sprinkler head comprises an arrangement of spray tubing generally lying in a first plane, and the wind driven device comprises a generally two-dimensional object having at least one rest position in which it lies generally in the first plane.

7. The apparatus of claim 1, wherein the wind-driven device has an interior region bounded by its own rotation, and the sprinkler head further includes a decorative feature located inside the wind-driven device's interior region to rotate with the sprinkler head.

8. The apparatus of claim 1, wherein the wind-driven device is rotatably supported on a lower portion of the sprinkler head.

9. The apparatus of claim 1, wherein the wind-driven device is rotatably supported from an upper portion of the sprinkler head.

10. The apparatus of claim 1, wherein the wind-driven device is rotatably supported from upper and lower portions of the sprinkler head.

* * * * *

UNITED STATES PATENT AND TRADEMARK OFFICE

CERTIFICATE OF CORRECTION

PATENT NO. : 6,588,679 B1
DATED : July 8, 2003
INVENTOR(S) : King

It is certified that error appears in the above-identified patent and that said Letters Patent is hereby corrected as shown below:

Column 3,
Line 17, please insert a space after "20*a*".

Signed and Sealed this

Sixteenth Day of September, 2003

JAMES E. ROGAN
*Director of the United States Patent and Trademark Office*